US012768565B2

(12) United States Patent
Ott

(10) Patent No.: US 12,768,565 B2
(45) Date of Patent: Oct. 20, 2026

(54) VENT ENCLOSURE

(71) Applicant: PRE-VENT SOLUTIONS LLC, Taylors, SC (US)

(72) Inventor: Keith Ott, Taylors, SC (US)

(73) Assignee: PRE-VENT SOLUTIONS LLC, Taylors, SC (US)

( * ) Notice: Subject to any disclaimer, the term of this patent is extended or adjusted under 35 U.S.C. 154(b) by 737 days.

(21) Appl. No.: 18/298,415

(22) Filed: Apr. 11, 2023

(65) Prior Publication Data

US 2023/0349586 A1 Nov. 2, 2023

Related U.S. Application Data

(60) Provisional application No. 63/349,684, filed on Jun. 7, 2022, provisional application No. 63/336,534, filed on Apr. 29, 2022, provisional application No. 63/336,532, filed on Apr. 29, 2022.

(51) Int. Cl.

| | |
|---|---|
| ***F24F 13/14*** | (2006.01) |
| ***F24F 13/08*** | (2006.01) |
| *F24F 7/00* | (2021.01) |
| *F24F 7/04* | (2006.01) |

(52) U.S. Cl.

CPC ..... *F24F 13/14* (2013.01); *F24F 13/084* (2013.01); *F24F 2007/001* (2013.01); *F24F 7/04* (2013.01)

(58) Field of Classification Search

CPC ..... F24F 7/02; F24F 7/04; F24F 2007/001; F24F 13/14; F24F 13/084

See application file for complete search history.

(56) References Cited

U.S. PATENT DOCUMENTS

| | | | | |
|---|---|---|---|---|
| 3,145,643 | A | 8/1964 | Strouth | |
| 3,285,155 | A | 11/1966 | Maltenfort | |
| 3,842,722 | A * | 10/1974 | Miller | F24F 13/06 137/527.6 |
| 4,047,475 | A | 9/1977 | Cox | |
| 5,344,363 | A | 9/1994 | Pollock | |
| 5,607,355 | A * | 3/1997 | Van Becelaere | A62C 2/16 285/424 |
| 5,729,935 | A * | 3/1998 | Schiedegger | F24F 13/08 52/27 |
| 6,772,538 | B2 | 8/2004 | Vagedes | |
| 7,988,544 | B2 | 8/2011 | Vanden Bosch et al. | |
| 9,850,620 | B2 | 12/2017 | Ott | |
| 2007/0120036 | A1 * | 5/2007 | Olle | F24F 13/0254 248/615 |
| 2011/0097990 | A1 | 4/2011 | Charron | |

* cited by examiner

*Primary Examiner* — Allen R. B. Schult

(74) *Attorney, Agent, or Firm* — Price Heneveld LLP

(57) ABSTRACT

A vent enclosure includes an adapter strap that is configured to extend around a vent member. The adapter strap has a plurality of attachment features. The adapter strap has fastening ends. The vent enclosure further includes a fastener that is attached to the fastening ends to secure the adapter strap in an encircling position, and a hood that is attached to the attachment feature of the adapter strap.

14 Claims, 13 Drawing Sheets

VENT ENCLOSURE

CROSS-REFERENCE TO RELATED APPLICATIONS

This application claims priority to and the benefit under 35 U.S.C. § 119(e) of U.S. Provisional Patent Application No. 63/336,532, filed on Apr. 29, 2022, entitled "VENT ENCLOSURE," and U.S. Provisional Patent Application No. 63/336,534, filed on Apr. 29, 2022, entitled "VENT ENCLOSURE," and U.S. Provisional Patent Application No. 63/349,684, filed Jun. 7, 2022, entitled "VENT ENCLOSURE," the entire disclosures of which are hereby incorporated herein by reference.

FIELD OF THE DISCLOSURE

The present device generally relates to enclosures for vents that can be attached to residential or commercial structures. More specifically, the device is directed toward an enclosure that includes a mount and a hood that is attached to the mount for minimizing unwanted openings of the vent due to exterior winds and nesting animals.

BACKGROUND OF THE DISCLOSURE

Residential and commercial structures include vents that allow for the ingress and, typically, the egress of ventilation air between the structure and areas surrounding the structure. These vents also present an opening in a structure through which birds and other creatures can enter into a structure. These vents typically include some type of barrier that prevents creatures from entering into the structure via these paths.

SUMMARY OF THE DISCLOSURE

In at least one aspect, a vent enclosure includes an adapter strap that is configured to extend around a vent member. The adapter strap has a plurality of attachment features. The adapter strap has fastening ends. The vent enclosure further includes a fastener that is attached to the fastening ends to secure the adapter strap in an encircling position, and a hood that is attached to the attachment feature of the adapter strap.

According to another aspect of the present disclosure, a vent enclosure for an exterior of a structure includes a mount that selectively attaches to the structure. The mount includes an airflow aperture. The mount also includes a receiver that is configured to receive a vent mechanism within the mount and proximate the airflow aperture. The mount has a plurality of securing features configured to secure the vent mechanism within the receiver. The vent enclosure further includes a hood that selectively attaches to the mount. The hood is configured to cover the mount and the receiver from above and lateral sides. The hood engages the mount in an at least one of a slidable engagement and a resiliently flexing engagement.

According to yet another aspect of the present disclosure, a vent enclosure for an exterior of a structure includes a mount that has a frame that is configured to selectively attach to said structure. The mount includes an airflow aperture that is disposed within the frame. The frame has an inner perimeter that defines a receiver that selectively receives a vent mechanism and positions the vent mechanism relative to the airflow aperture. The frame of the mount also has an outer periphery that defines a plurality of attachment features. The vent enclosure further includes a hood that selectively attaches to the plurality of attachment features of the mount. The hood is configured to cover the mount and the receiver from above and lateral sides of the frame. The hood engages the mount in at least one of a slidable engagement and a resiliently flexing engagement.

These and other features, advantages, and objects of the present disclosure will be further understood and appreciated by those skilled in the art by reference to the following specification, claims, and appended drawings.

Figure 1:
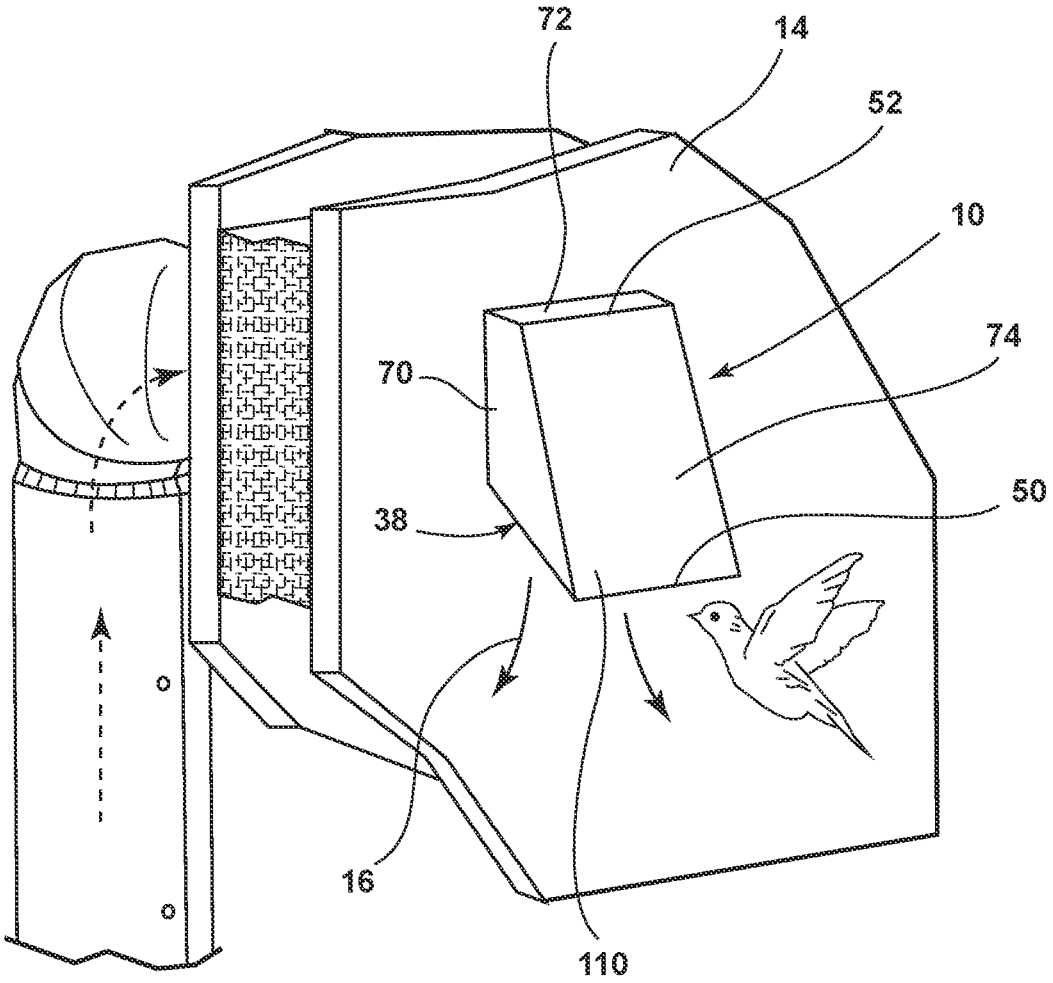
FIG. 1 is a front perspective view if an aspect of the vent enclosure attached to a structure.

The components in the figures are not necessarily to scale, emphasis instead being placed upon illustrating the principles described herein.

DETAILED DESCRIPTION

As required, detailed embodiments of the present disclosure are disclosed herein;

however, it is to be understood that the disclosed embodiments are merely exemplary of the invention that may be embodied in various and alternative forms. The figures are not necessarily to a detailed design; some schematics may be exaggerated or minimized to show function overview. Therefore, specific structural and functional details disclosed herein are not to be interpreted as limiting, but merely as a representative basis for teaching one skilled in the art to variously employ the present invention.

For purposes of description herein, the terms "upper," "lower," "right," "left," "rear," "front," "vertical," "horizontal," and derivatives thereof shall relate to the concepts as oriented in FIGS. 1-6. However, it is to be understood that the concepts may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The present illustrated embodiments reside primarily in combinations of method steps and apparatus components related to a vent enclosure. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

As used herein, the term "and/or," when used in a list of two or more items, means that any one of the listed items can be employed by itself, or any combination of two or more of the listed items, can be employed. For example, if a composition is described as containing components A, B, and/or C, the composition can contain A alone; B alone; C alone; A and B in combination; A and C in combination; B and C in combination; or A, B, and C in combination.

In this document, relational terms, such as first and second, top and bottom, and the like, are used solely to distinguish one entity or action from another entity or action, without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises . . . a" does not, without more constraints, preclude the existence of additional identical elements in the process, method, article, or apparatus that comprises the element.

As used herein, the term "about" means that amounts, sizes, formulations, parameters, and other quantities and characteristics are not and need not be exact, but may be approximate and/or larger or smaller, as desired, reflecting tolerances, conversion factors, rounding off, measurement error and the like, and other factors known to those of skill in the art. When the term "about" is used in describing a value or an end-point of a range, the disclosure should be understood to include the specific value or end-point referred to. Whether or not a numerical value or end-point of a range in the specification recites "about," the numerical value or end-point of a range is intended to include two embodiments: one modified by "about," and one not modified by "about." It will be further understood that the end-points of each of the ranges are significant both in relation to the other end-point, and independently of the other end-point.

The terms "substantial," "substantially," and variations thereof as used herein are intended to note that a described feature is equal or approximately equal to a value or description. For example, a "substantially planar" surface is intended to denote a surface that is planar or approximately planar. Moreover, "substantially" is intended to denote that two values are equal or approximately equal. In some embodiments, "substantially" may denote values within about 10% of each other, such as within about 5% of each other, or within about 2% of each other.

As used herein the terms "the," "a," or "an," mean "at least one," and should not be limited to "only one" unless explicitly indicated to the contrary. Thus, for example, reference to "a component" includes embodiments having two or more such components unless the context clearly indicates otherwise.

Referring to FIGS. 1-6, reference numeral 10 generally refers to an enclosure for a vent 12, where the enclosure 10 and the vent 12 can be attached to an exterior of a structure 14 for allowing an outflow of exhaust air 16 through an airflow aperture 18, but preventing inward egress through the airflow aperture 18, such as by debris, air currents, and animals that tend to nest within and on conventional vents.

Referring now to FIGS. 1-10, according to various aspects of the device, the enclosure 10 for the vent 12 can include a mount 30 having a frame 40 that selectively attaches to the exterior of a structure 14. The mount 30 includes the airflow aperture 18. A door 32 is pivotally attached to the mount 30, where the door 32 is selectively operable between a blocking position 34 that covers the airflow aperture 18, and an outflow position 36 that is rotationally distal from the airflow aperture 18. The door 32 moves from the blocking position 34 to the outflow position 36 in response to the outward movement of exhaust air 16 through the airflow aperture 18. This is typically true during the operation of a laundry dryer or fan, where exhaust air 16 is blown out from the structure 14. This outflow of exhaust air 16 biases the door 32 to the outflow position 36 and allows this exhaust air 16 to escape the structure 14. When the blower (not shown) inside the structure 14 stops operation, the outflow of exhaust air 16 also stops and gravity biases the door 32 back to the blocking position 34 and covering the airflow aperture 18. A hood 38 selectively attaches to the mount 30, typically at a frame 40 of the mount 30, and encloses on three sides of the mount 30 and the door 32.

In certain aspects of the device, as exemplified in FIGS. 3-7, the hood 38 and the mount 30 include a generally truncated shape that tapers from a lower edge 50 or lower section to an upper edge 52 or upper section. The upper edge 52 being narrower than the lower edge 50 such that the upper section or the upper edge 52 has a width that is smaller than the width of the hood 38 within the lower section or the lower edge 50. This truncated shape can be used to provide a smaller space at the top of the hood 38 on which a bird or other animal may seek to build a nest. This configuration allows for a plurality of hoods 38 or entire hood enclosures 10 to be placed in a stacked configuration without causing any bending or other undesirable deflection of the components of the hood enclosures 10. The plurality of hood members, or the plurality of hood enclosures 10 can be stacked relative to one another for shipping and storage purposes. As discussed herein, the truncated shape of the hood 38 also provides for a nesting configuration 54 when multiple enclosures 10, including the hoods 38, doors 32 and mounts 30 are packaged for shipping.

Referring again to FIGS. 1-10, as well as FIGS. 11-15, the hood 38 is typically made from one-piece and includes opposing sidewalls 70, an angled wall 76, and a top wall 72 that join to form a downwardly and outwardly-extending chute 74 extending well below a lower mount edge 112 of the mount 30 and below the door 32. The size and shape of the hood 38 and the chute 74 are configured to discourage birds and other animals from approaching the airflow opening and also from building a nest or other habitation on the hood 38. The de minimus size of the top wall 72 and the steep slope of the chute 74 provide little to no purchase for animals that would seek to build a nest or other habitation thereon.

Referring again to FIGS. 2 and 3, the door 32 includes a door flange 90 and the mount 30 includes a mount flange 92 that are positioned at the bottom of the door 32 and mount 30, respectively. The door flange 90 and the mount flange 92 each extend outward and in a generally oblique angle with respect to the structure 14. This configuration provides a minimal clearance space 94 between the door flange 90 and the mount flange 92. In this manner, as the door 32 moves between the blocking position 34 and the outflow position 36, the door flange 90 passes by the mount flange 92 with little available clearance space 94. This minimal clearance space 94 prevents birds and other animals from prying the door 32 away from the mount 30 and prevents access to the airflow aperture 18. Typically, the door 32 is incorporated within a vent mechanism that is received within the mount 30. The vent mechanism can be an after-market component or a separately purchased component that is installed and selectively secured within the receiver defined within the mount.

The mount 30, the hood 38, and the door 32 are all generally made of a metal construction and each including a relatively flat main panel 130 and having stiffening bends or bent panel sections that extend from edges of the flat main panel 130. The hood 38 includes the opposing sidewalls 70 and an angled front wall 110 and the top wall 72 that join to form the downwardly and outwardly-extending chute 74 that extends below the door 32 and the lower mount edge 112 of the mount 30.

Referring again to FIGS. 1-10, the mount 30 is sized to form the airflow aperture 18 that tends to cooperate with conventional sizes of air ducts seen within residential and commercial structures 14. The mount 30 can include stiffening flanges 120 on all four sides, including the mount flange 92. The mount flange 92 of the mount 30 being positioned at an oblique angle with respect to the remainder of the mount 30. Typically, the mount flange 92 is angled upwardly and toward the door 32 to generate the minimal clearance space 94 described herein.

Figure 2:
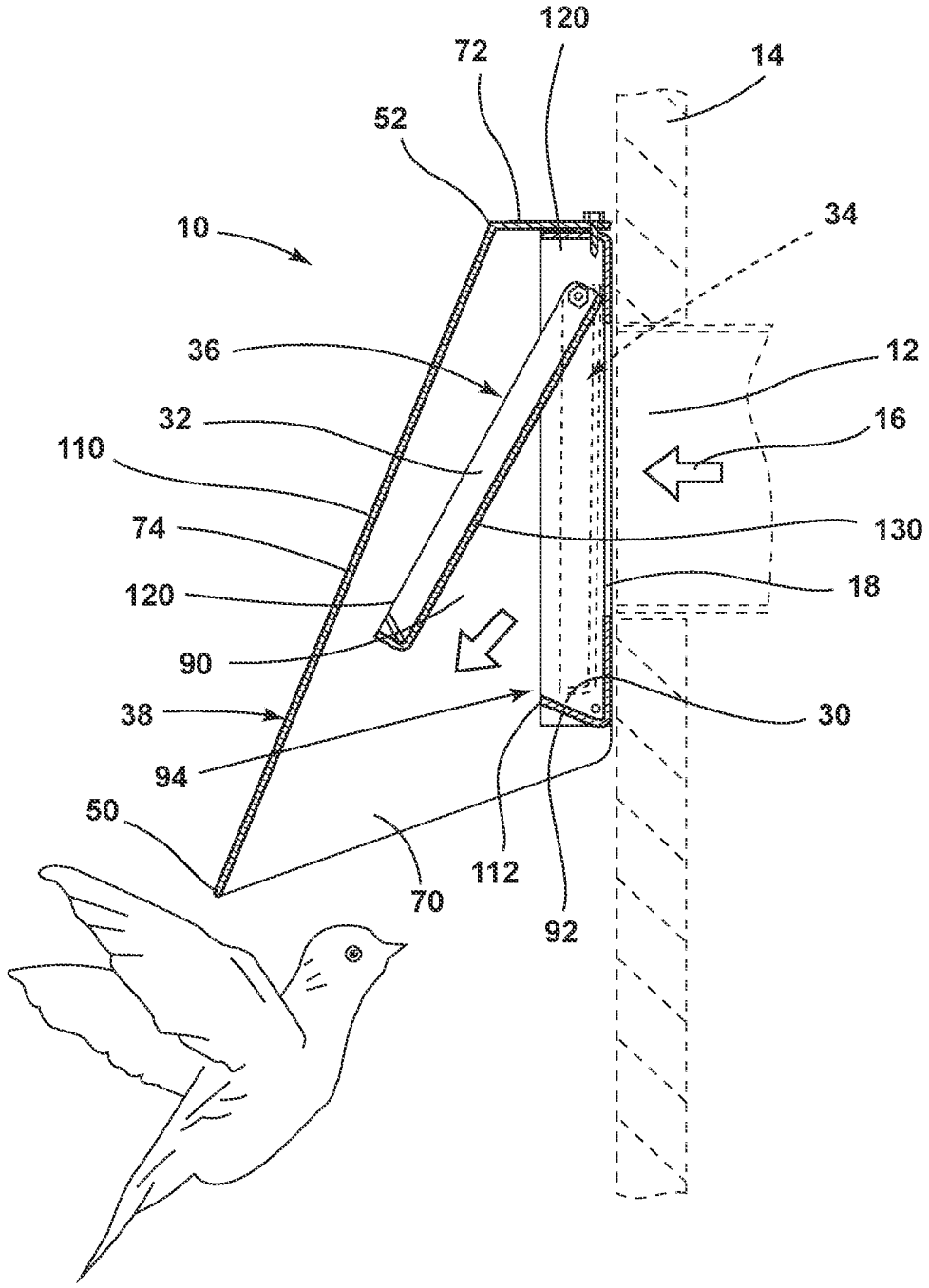
FIG. 2 is cross-sectional view of an aspect of the vent enclosure attached to the structure and showing movement of air flow through the vent enclosure.
Figure 3:
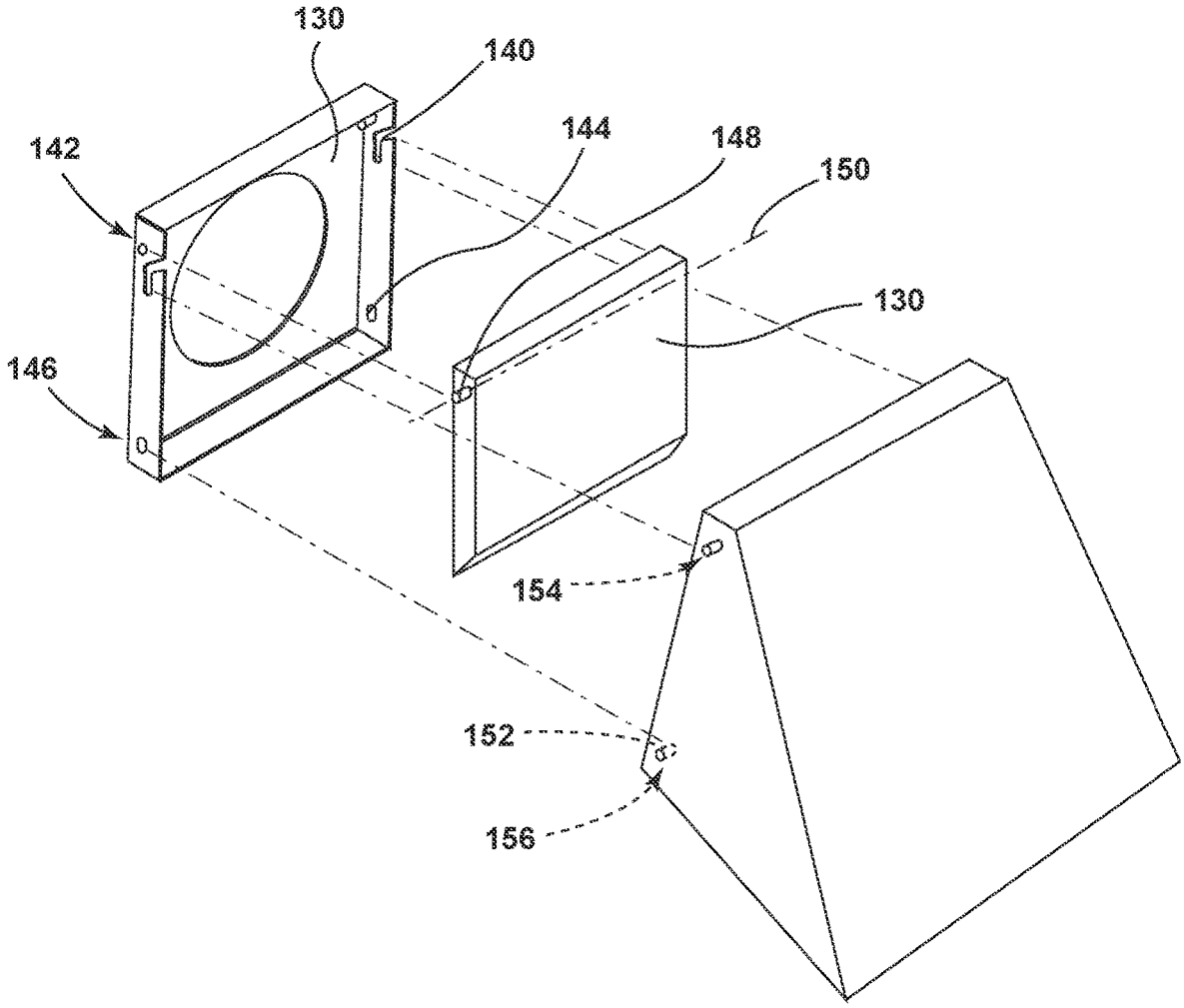
FIG. 3 is an exploded perspective view of an aspect of the vent enclosure.

As exemplified in FIGS. 1-3, the door 32 includes a planar main panel 130 and includes the stiffening flanges 120 at its sides, including the door flange 90. As described herein, the door flange 90 is positioned at an oblique angle, and can be generally parallel with the mount flange 92 of the mount 30 when the door 32 is in the blocking position 34. Other angular configurations of the door flange 90 and the mount flange 92 are also contemplated. As would be described herein, a number of attachment configurations can be utilized for attaching the hood 38 to the mount 30.

Referring to FIGS. 1-10, the enclosure 10 for the vent 12 can include the mount 30 that selectively attaches to the structure 14. The mount 30 includes the airflow aperture 18. The stiffening flanges 120 of the mount 30 define an outer wall that includes a plurality of slots 140, typically in the form of opposing mounting slots 140 within an upper portion 142 of the mount 30. Opposing mounting apertures 144 are also positioned within a lower portion 146 of the mount 30, typically within the stiffening flanges 120. The door 32 is pivotally attached to the mount 30, typically via a shaft 148 or other hinge that provide a rotational axis 150 about which the door 32 operates relative to the mount 30. As described herein, the door 32 is operable between the blocking position 34 that covers the airflow aperture 18 and the outflow position 36 that is rotationally distal from the outflow aperture. Movement of the door 32 is accomplished in response to the outward movement of exhaust air 16 through the airflow aperture 18 from the inside of the structure 14.

The hood 38 selectively attaches to the mount 30. The hood 38 includes upper opposing pins 154 that slidably and respectively engage the opposing mounting slots 140 defined within the stiffening flanges 120 of the mount 30. When the hood 38 is attached to the mount 30, the upper opposing pins 154 are slidably disposed within the opposing mounting slots 140 and rest, according to the force of gravity, within these slots 140. The hood 38 also includes lower opposing pins 156 that respectively engage the opposing mounting apertures 144 defined within the stiffening flanges 120 of the mount 30. The hood 38 is configured to be resilient and flex outward. This outward flexion of the sidewalls 70 of the hood 38 allow the lower opposing pins 156 of the hood 38 to flex outside the stiffening flanges 120 so that the pins 152 can bypass a portion of the stiffening flanges 120 and move into alignment with the opposing mounting apertures 144 within the lower portion 146 of the mount 30. During this installation of the lower opposing pins 156 of the hood 38 within the opposing mounting slots 140 of the mount 30, the upper opposing pins 154 remain disposed within the upper mounting slots 140. When all four of the pins 152 of the hood 38 are disposed within the respective slots 140 and apertures 144 of the mount 30, the hood 38 is fixed in place and cannot be removed without first removing the lower opposing pins 156 from the opposing mounting apertures 144 of the mount 30.

Figure 4:
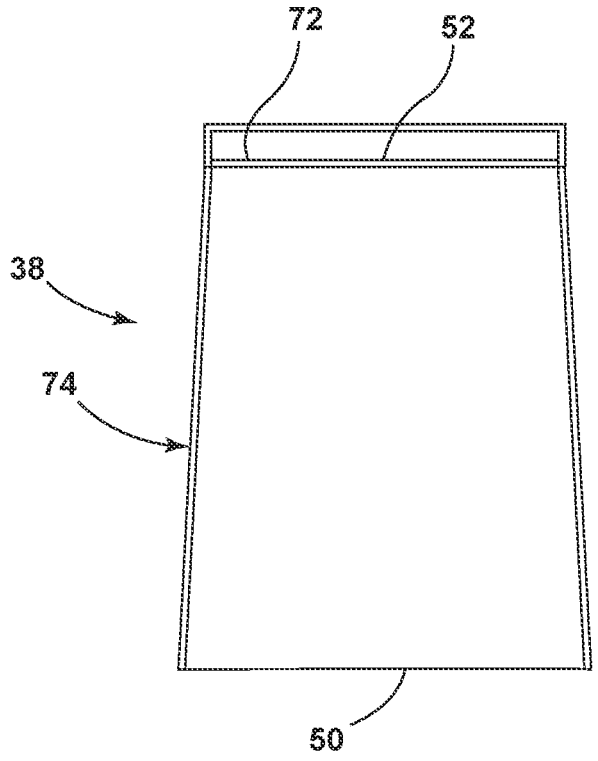
FIG. 4 is a side elevation view of the vent enclosure of FIG. 3.
Figure 5:
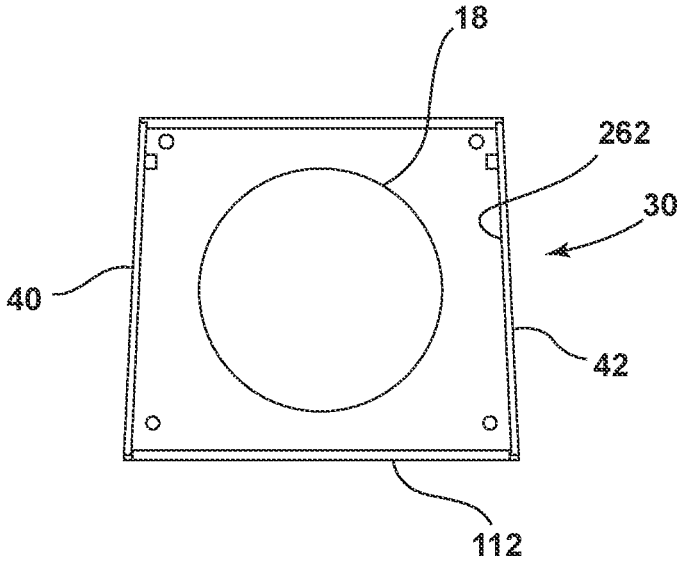
FIG. 5 is an elevation view of the mount for the vent enclosure of FIG. 3.
Figure 6:
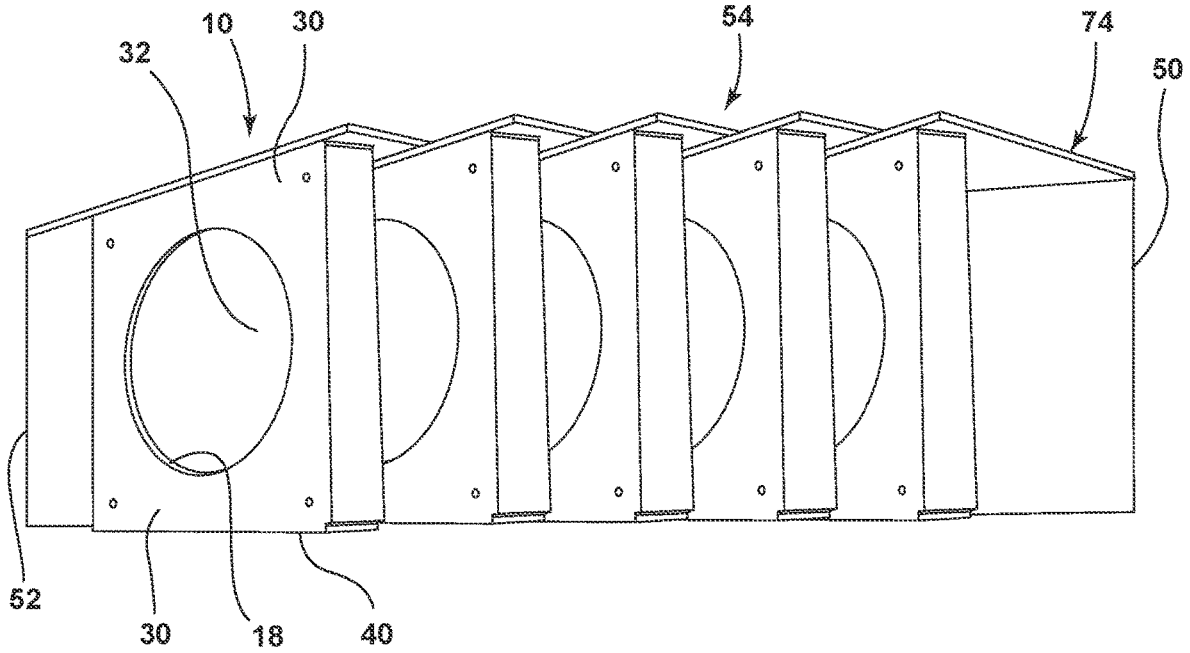
FIG. 6 is a perspective view of a plurality of hood enclosures stacked in a nesting configuration based upon the truncated shape of the vent enclosures.
Figure 7:
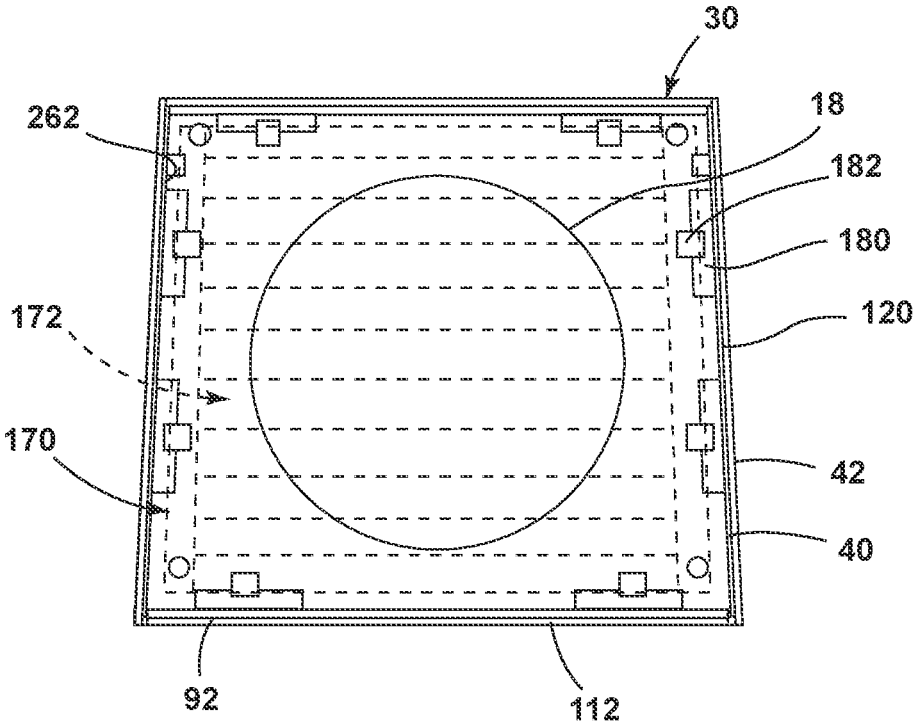
FIG. 7 is a schematic elevation view of a mount for the vent enclosure and showing, in phantom, a vent mechanism installed in the mount.
Figure 8:
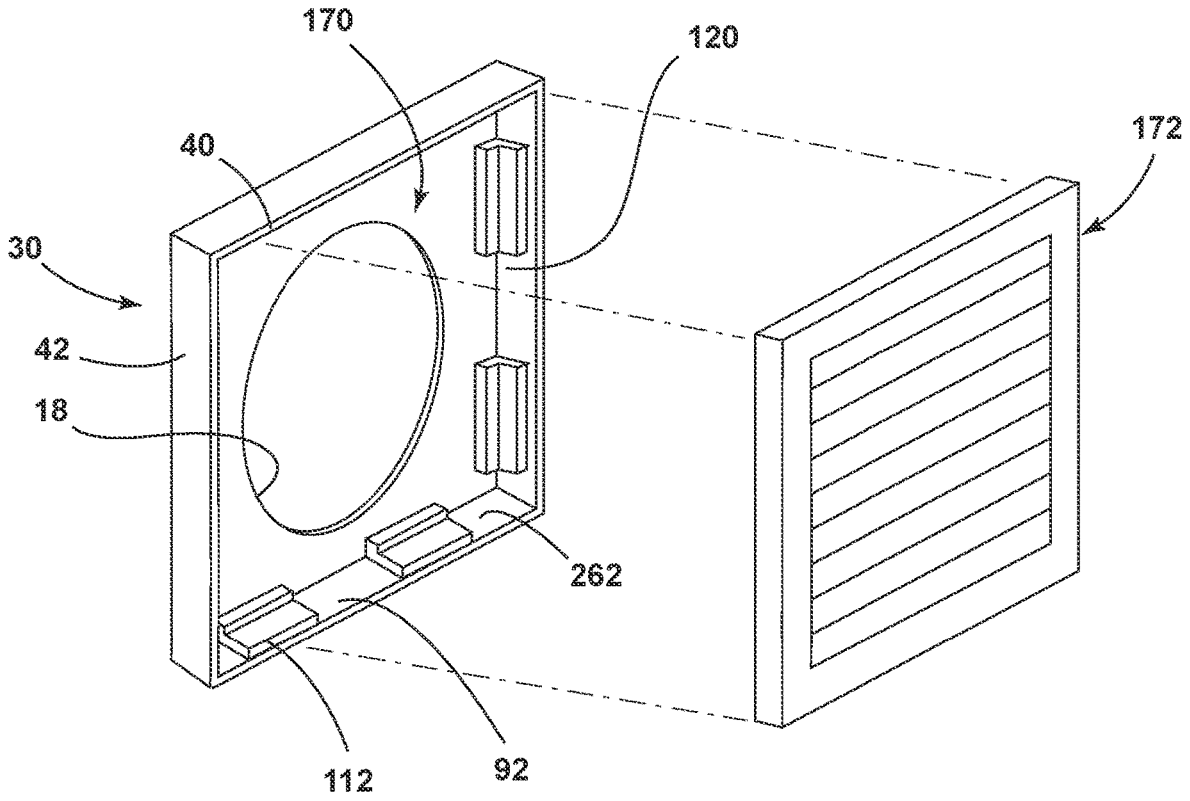
FIG. 8 is an exploded perspective view of a vent mechanism and an aspect of the mount.
Figure 9:
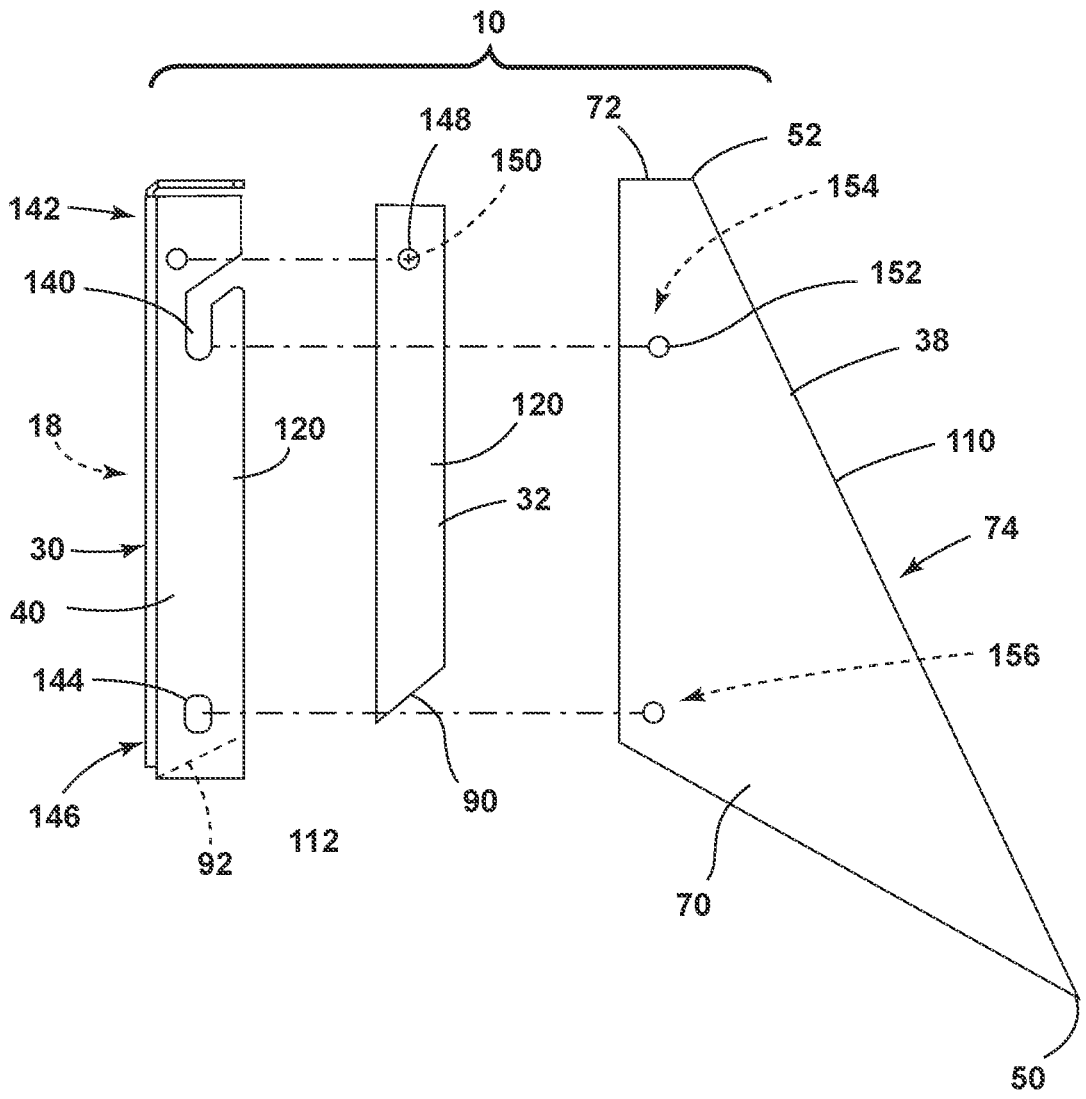
FIG. 9 is an exploded elevation view of an aspect of the vent enclosure.
Figure 10:
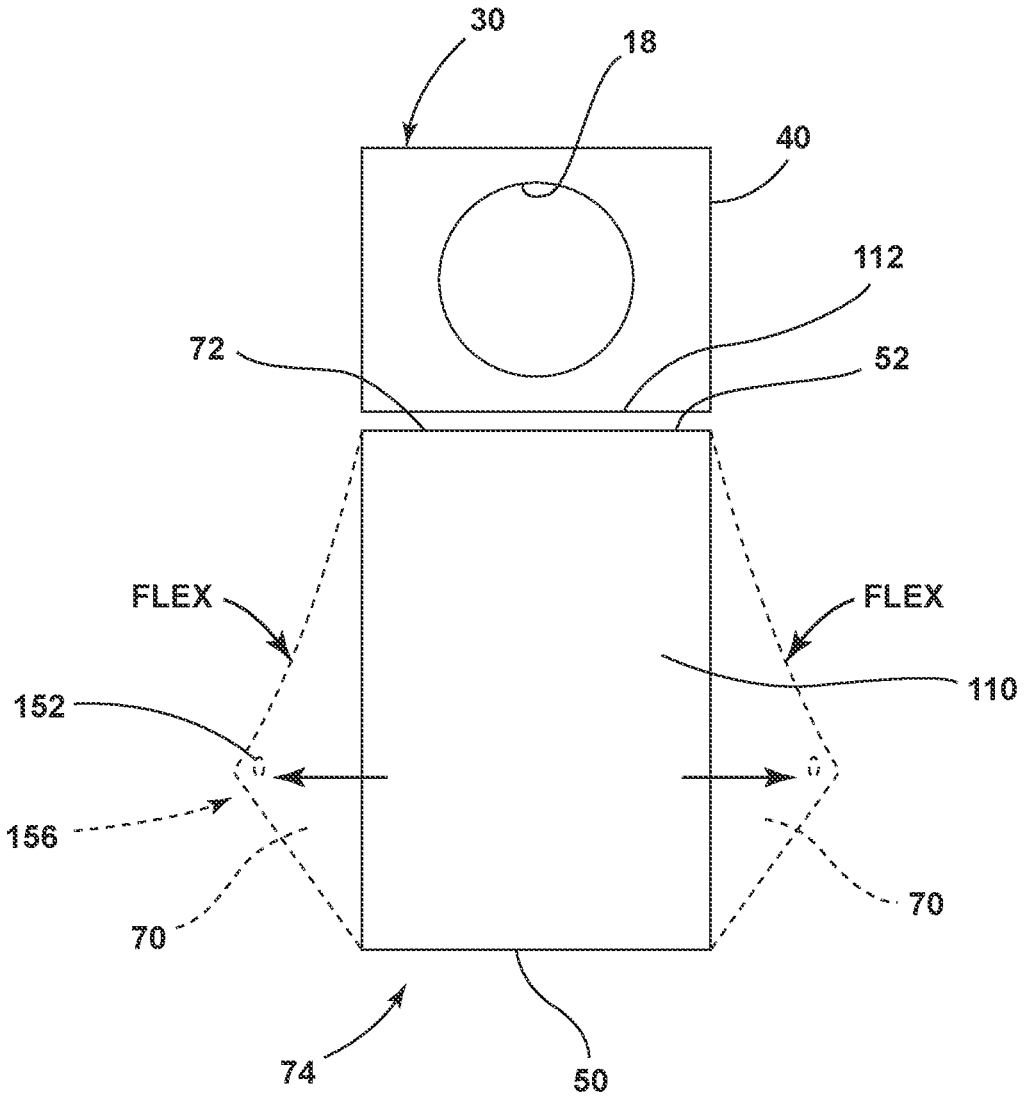
FIG. 10 is a schematic perspective view of an aspect of the vent enclosure and showing flexion of the hood member for installation of the hood on to the mount.
Figure 11:
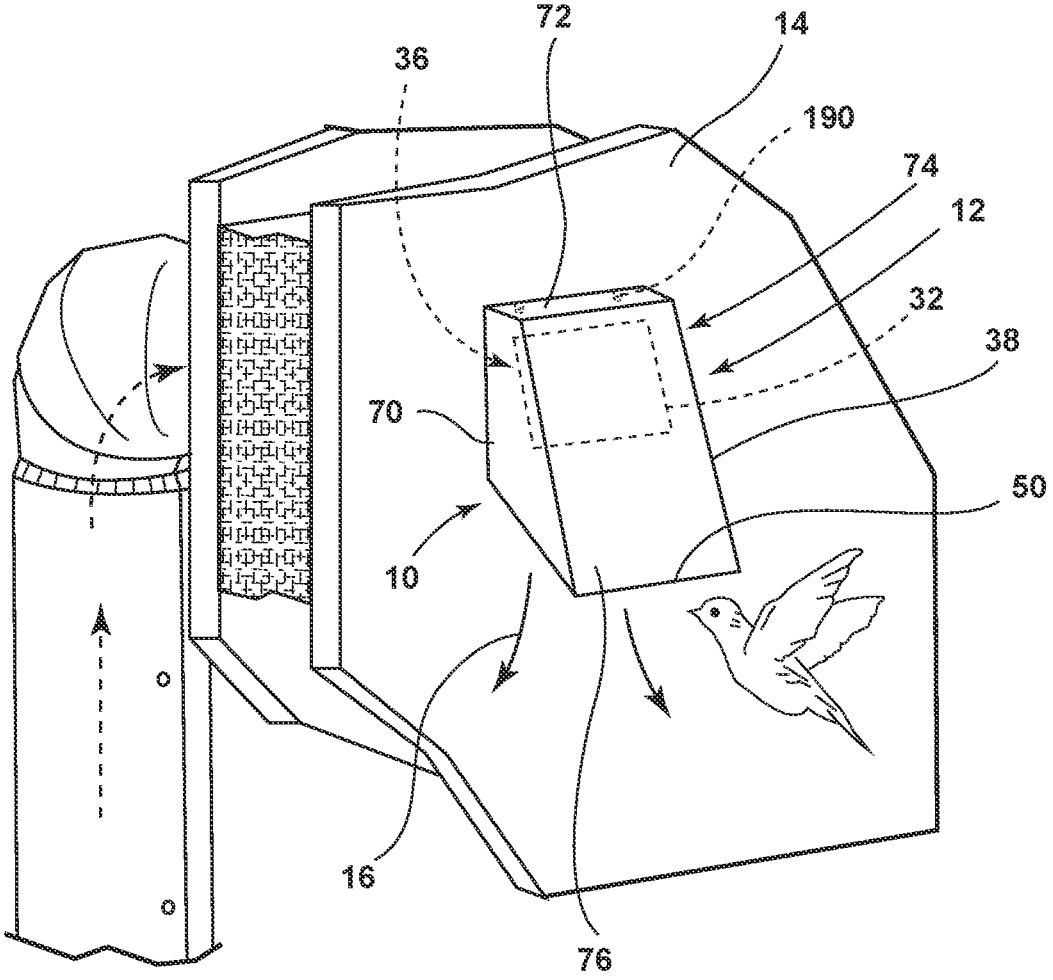
FIG. 11 is a front perspective view of an aspect of the vent enclosure.

The configuration of the hood 38 and the slots 140 and apertures 144 of the mount 30 can take various configurations. As shown in FIGS. 3 and 4, the truncated shaped of the hood 38 and the mount 30 can utilize the attachment configuration described herein. Rectilinear and other shape configuration can also be utilized in connection with these attachment slots 140 and apertures 144.

Referring again to FIGS. 1-10, the enclosure 10 can include a hood 38 and mount 30 that can be used in combination with a separate after-market vent 172. Many conventional vents 12 have been shown to be inadequate at preventing ingress of birds and other animals during use. Some animals are clever enough to understand how to circumvent basic louvers and flaps of conventional vents 12. Accordingly, utilizing the hood 38 and the mount 30 described herein, in combination with an after-market vent 172, provides an added layer of protection against the ingress of unwanted pests and animals into an particular structure 14.

According to various aspects of the device, the vent 12 enclosure 10 includes the mount 30 that selectively attaches to the structure 14. The mount 30 includes the airflow aperture 18 that allows air to move from within the structure 14, through a particular vent 12, and to the atmosphere outside the structure 14. The mount 30 also defines a receiver 170 within the stiffening flanges 120 of the mount 30 that is configured to receive the after-market vent 172. The receiver 170 positions the after-market vent 172 within an inner perimeter 262 of a frame 40 of the mount 30. In turn, these stiffening flanges 120 also place the after-market vent 172 into alignment with the airflow aperture 18 such that the louvres or other airflow regulating mechanism of the after-market vent 172 can operate in response to the movement of air through the airflow aperture 18.

According to the various aspects of the device, the receiver 170 within the mount 30 can include various resilient members 180 that can be used to assist in securing the after-market vent 172 within the receiver 170 of the mount 30. Various deflecting members, springs, fasteners 240, and other similar mechanisms can secure the after-market vent 172 within the receiver 170 of the mount 30. Attachment of the hood 38 to the mount 30 can be accomplished according to the various conventions described herein. The receiver 170 and the resilient members 180 can be configured to provide for the selective release of an after-market vent 172, as well as the installation or reinstallation of a replacement vent mechanism 172. In this manner, over the life of the vent enclosure 10, the receiver 170 can be utilized over time to remove and replace vent members 172, as needed. The resilient members 180 also provide a retaining mechanism that prevents or limits movement of the after-market vent 172 within the receiver 170. In this manner, the resilient members 180 prevent vibration of the after-market vent 172 that may lead to rattling or other unwanted noise between the receiver 170 of the mount 30 and the after-market vent 172. In this manner, the resilient members 180 typically engage an outer edge of the after-market vent 172 and exert a biasing or retaining force that secures the after-market vent 172 within the receiver 170.

According to the various aspects of the device, the receiver 170 for the mount 30 can also include various securing features 182, typically a plurality of securing features 182, that can prevent outward movement of the after-market vent 172 with respect to the structure 14. Where the securing features 182 are used, the securing features 182 can engage the front edge of the after-market vent 172. Through this engagement, the after-market vent 172 is secured within the receiver and, typically, is not readily separable from the mount 30 without the use of tools. Additionally, the securing features 182, in combination with the resilient members 180, operate to secure the after-market vent 172 within the receiver 170 and also prevent vibration and other movement of the after-market vent 172 within the receiver 170. The securing features 182 described herein can prevent this outward movement such that animals are generally incapable of separating the vent 12 from the receiver 170. These securing features 182 can include, but are not limited to, raised sections of the frame 40 for the mount 30, apertures within the frame 40 that include a raised edge that can engage and secure the after-market vent 172, tabs, textured portions of the frame 40, resilient section of the frame 40, additional interference materials that can secure the after-market vent 172, combinations thereof, and other similar raised sections of retaining mechanisms of the frame 40. As described herein, the shape of the hood 38 prevents nesting or the building of animal habitations on the top wall 72 of the hood 38. Additionally, the shape and smooth configuration of the hood 38 prevents animals from finding purchase on a surface of the hood 38 from which they can access the after-market vent 172 contained within the receiver 170 for the mount 30.

According to the various aspects of the device, the resilient members 180 of the mount 30 that are configured to secure the after-market vent 172 into the receiver 170 can include adjustment mechanisms that provide for different sizes of after-market vents 172. Typically, most vents 12 are configured to have an airflow path that cooperates with generally typical sizes of duct work that are contained within the structure 14. Accordingly, the outer perimeter of these after-market vents 172 generally conforms to a similar size and shape. Variability in these after-market vents 172 can be found, such that adjustability within the receiver 170, can be used with any one of various after-market vents 172 for securing these after-market vents 172 within the receiver 170 of the mount 30. Accordingly, the resilient members 180 and the securing features 182 of the receiver 170 are configured to accommodate a variety of sizes and shapes of after-market vents 172.

It is contemplated that the mount 30 having the receiver 170 can be used within after-market vents 172 that are made of any one of various materials. Such materials can include plastic, various polymers, metals, and other similar materials.

Referring to FIGS. 1-15, reference numeral 10 generally refers to a vent enclosure that can be attached to a structure 14 for allowing an outflow of exhaust air 16 from the inside of the structure 14 to the outer atmosphere surrounding the structure 14. The vent enclosure 10 also includes various doors 32, louvres, or other operable members that are closed to prevent an inflow of air and also to previous ingress of various insects and animals inside the structure 14.

Referring now to FIGS. 10-15, the structure 14 can include various vent members 172 that are attached to the structure 14 and typically at or proximate a vent aperture 232, or other airflow aperture, that allows for an outflow of exhaust air 16. The vent enclosure 10 includes an adapter strap 234 that is configured to extend around the vent member 172. The adapter strap 234 includes a plurality of attachment features 236 and also includes fastening ends 238. A fastener 240 is attached to the fastening ends 238 to secure the adapter strap 234 in an encircling position 242 about the after-market vent member 172. The encircling position 242 of the adapter strap 234 defines an inner perimeter 262 that defines a receiver 170 that receives, or is received by, the after-marker vent member 172. A hood 38 is attached to the attachment features 236 of the adapter strap 234 so the hood 38 can be secured to the after-market vent member 172. Accordingly, the adapter strap 234 cooperates with the hood 38 and the after-market vent member 172 to prevent unwanted ingress by various animals. The adapter strap 234 in the encircling position 242 defines an outer periphery 42 of the frame 40 that defines the plurality of attachment features 236. The hood 38 engages with these attachment features 236 to secure the hood 38 relative to the vent aperture 232. In this manner, the attachment features 236 in the encircling position 242 locates the hood 38 to extend over the adapter strap 234 and cover the receiver 170 that is formed by the inner perimeter 262 of the adapter strap 234.

In certain aspects of the device the adapter strap 234 includes certain tabs 190 that extend between the after-market vent member 172 and the structure 14. In this configuration, the adapter strap 234 in the encircling position 242 engages the outer edge of the after-market vent member 172. Additionally, the tabs 190 that extend from the inner perimeter 262 of the adapter strap 234 engage a rear surface of the after-market vent member 172 and occupy a gap formed between the after-market vent member 172 and the structure 14. The use of the tabs 190 operated to prevent the adapter strap 234 from being pulled off from the after-market vent member 172.

Referring again to FIGS. 10-15, the fastening ends 238 of the adapter strap 234 can include a plurality of apertures 260 that are configured to receive the fastener 240. This fastener 240 can be any one of various fasteners that can include, but are not limited to, threaded fasteners, resilient fasteners, clasps, hooks, latches, hasps, interlocking fasteners, combinations thereof, and other similar fastening mechanisms and fastening methods. These apertures 260 can be used to vary the inner perimeter 262 of the adapter strap 234 in the encircling position 242. In this manner, the adapter strap 234 can be used to encircle any one of various after-market vent members 172 that are various shapes and sizes. It is also contemplated that the adapter strap 234 can include a flexible or malleable member that can be used to encircle various after-market vent members 172. The flexible configuration of the adapter strap 234 can be used to encircle rectilinear vent members, arcuate vent members, and other vent members 172 having various shapes and sizes.

In certain aspects of the device, the adapter strap 234 can be incorporated into the hood 38. In such a configuration, the hood includes the tabs 190 and the fastening ends 238. Typically, the hood 38 having the integral adapter strap 234 can be used to secure the hood 38 to a plastic version of the after-market vent member 172. Where the after-market vent member 172 is made of plastic, the after-market vent member 172 may not be sufficiently robust to support the weight of the hood 38. Accordingly, the tabs 190 of the hood 38 with the integral adapter strap 234 can include apertures that allow for the installation of fasteners 240 that secure the hood 38 to the structure 14. In this manner, the after-market vent member 172 and the hood 38 having the integral adapter strap 234 are independently attached to the structure 14. Accordingly, the hood 38 is supported by the structure 38 and the adapter strap 234 that is integrally formed with the hood 38 is used to secure the hood around the plastic version of the after-market vent member 172.

Figure 12:
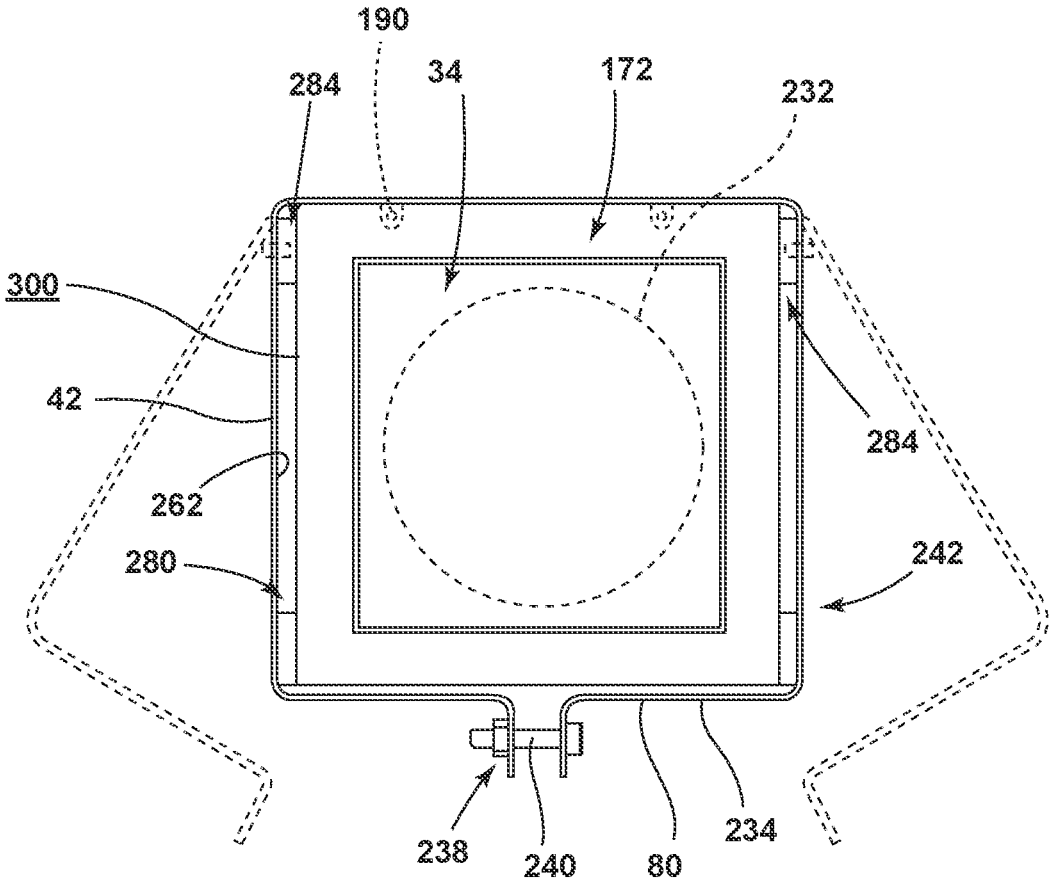
FIG. 12 is a schematic elevation view of an aspect of the vent enclosure and showing placement of an adapter strap around a vent member to define the encircling position of the adapter strap.
Figure 13:
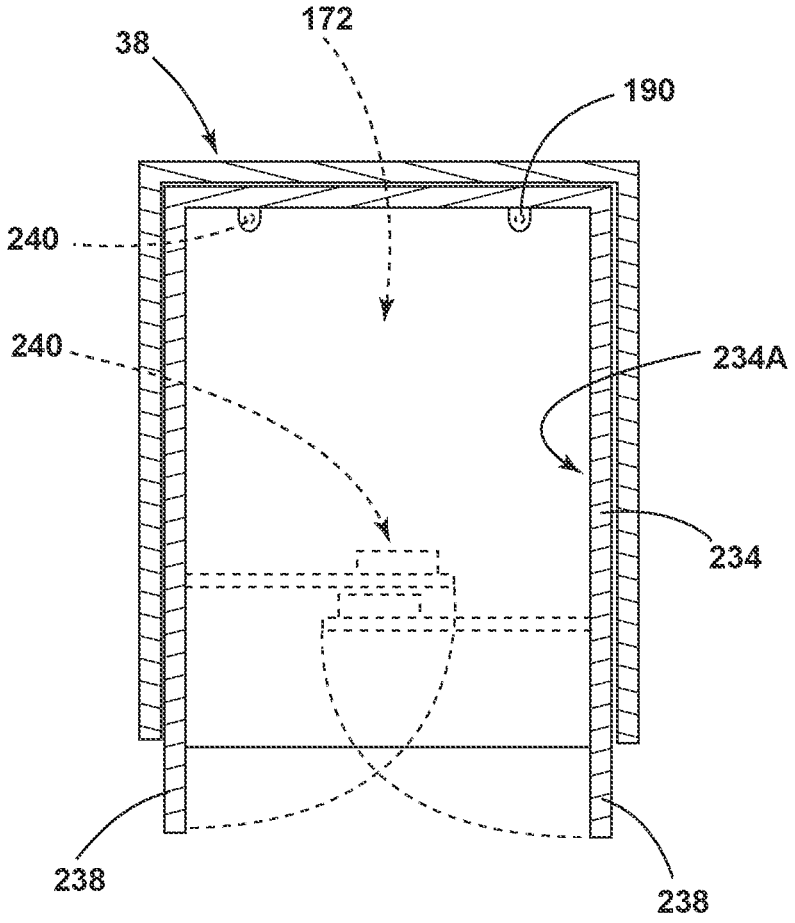
FIG. 13 is a schematic view of an aspect of the adapter strap and showing operation of the adapter strap into the encircling position.
Figure 14:
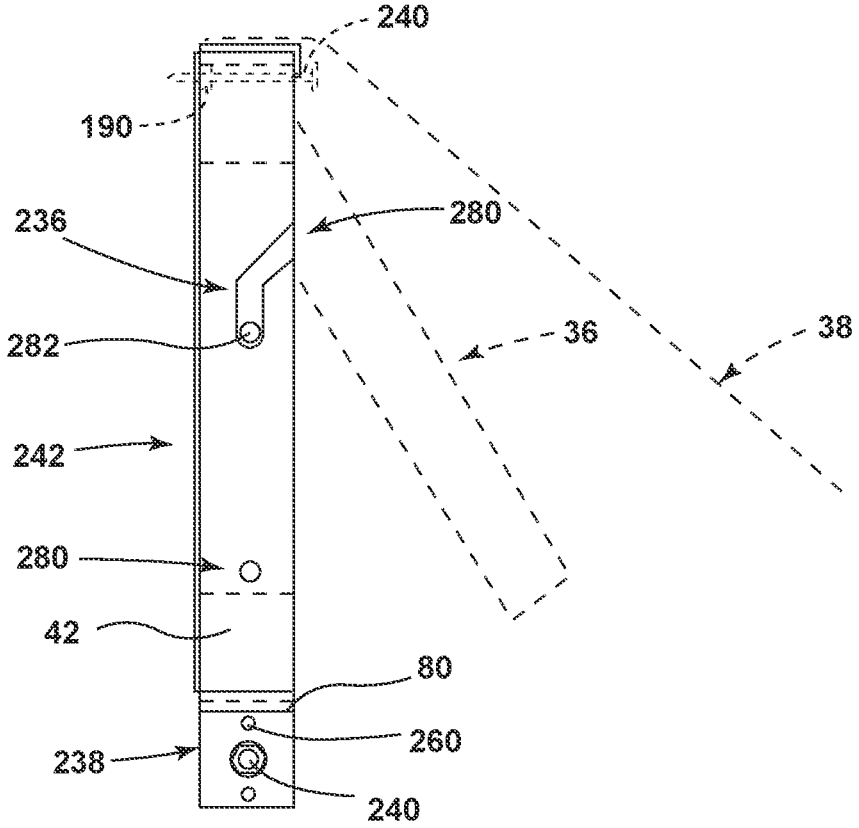
FIG. 14 is a schematic view of an aspect of the vent enclosure and showing attachment of the hood and the vent mechanism to the adapter strap.
Figure 15:
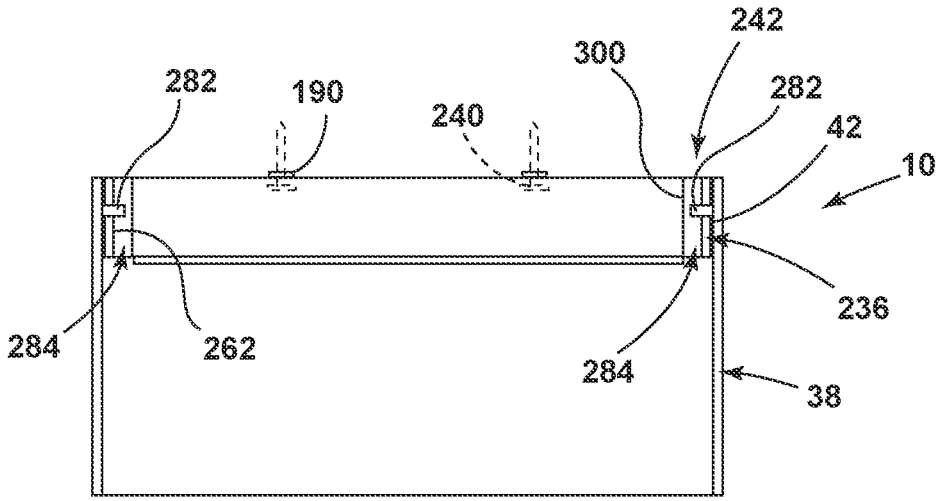
FIG. 15 is a bottom plan view of the vent mechanism of FIG. 11.

As exemplified in FIG. 12, the attachment features 236 of the adapter strap 234 can be recessed inward and, typically, can extend inward from the adapter strap 234. In this manner, these attachment features 236 provide an attachment space 284 to define various receptacles 280 that are configured to receive attachment protrusions 282 of the hood 38. These attachment protrusions 282 typically in the form of inwardly-extending pins can be slidably engaged or otherwise positioned within these receptacles 280 for securing the hood 38 to the adapter strap 234 in the encircling position 242. The plurality of receptacles 280 can be in the form of a plurality of slots that provide for a slidable engagement between the receptacles 280 and the attachment protrusions 282. The receptacles 280 can also be in the form of a plurality of openings that can receive the attachment protrusions 282 through a resiliently flexing engagement with the lateral sides of the hood 38. The plurality of receptacles 280 can also include a combination of the slots and the openings that can be used to secure the hood 38 to the adapter strap 234 or the mount 30, as described herein.

To receive the protrusions 282 of the hood 38, it is contemplated that the attachment features 236 of the adapter strap 234 can include a depth or attachment space 284 that sets the adapter strap 234 apart from the after-market hood 38. By setting the adapter strap 234 apart from the after-market hood 38, the attachment space 284 is defined that allows the pins to enter into and through the adapter strap 234, without puncturing or otherwise damaging the after-market vent member 172. This configuration allows for the hood 38 to be secured to the adapter strap 234, while the adapter strap 234 is secured to the after-market vent member 172. This also prevents the pins of the hood 38 from compromising the integrity of the after-market vent member 172 when the hood 38 is attached to the adapter strap 234.

According to various aspects of the device, as exemplified in FIG. 2, the fastener 240 can be in the form of a bolt, screw, or other similar fastener 240. It is also contemplated that the fastener 240 can cooperate with the various apertures 260 of the fastening ends 238 to form a worm-type configuration that allows for tightening of the adapter strap 234 as the fastener 240 is rotated relative to the fastening ends 238. In such configuration, as the fastener 240 is tightened, the shape of the adapter strap 234 in the encircling position 242 can change to conform to an outer surface 300 of the vent member 172.

It is contemplated that the adapter strap 234 can be utilized in any one of various after-market vent members 172. Such vent members 172 can be made of any one of various materials that can include, but not limited to, plastic, composite, resin, metal, ceramic, combinations thereof, and other similar materials that are typically seen in a residential, commercial, and industrial vents.

Referring again to FIGS. 1-15, the hood 38 can include opposing sidewalls 70 and an angled wall 76 and a top wall 72 that join to form a downwardly and outwardly-extending chute 74 that extends below a lower edge 50 of the vent member 230. The hood 38 can also be made from a single flat sheet with the sidewalls 70 and top wall 72 being formed by single bends along edges of the main angled wall 76. The bottom edge 80 of the angled wall 76 extends below the lower edge 50 of the vent member 172 sufficiently to prevent access or ingress to the vent aperture 232 by various animals and insects. The sidewalls 70 of the hood 38 define an inner lower corner adjacent to the structure 14 that preferably extends below the vent member 172 and downward which further helps to prevent ingress to the vent member 172. The top wall 72 of the hood 38 is made of a sufficiently small size to make it difficult for various animals to build nests or other habitations on the top wall 72 of the hood 38.

In certain aspects of the device, it is contemplated that the adapter strap 234 can be incorporated with the hood 38. In such an aspect, the adapter strap 234 can be welded, adhered fastened or otherwise attached to an interior surface of the hood 38. In this manner, the adapter strap 234 can form a "U" shaped profile 234A of the adapter strap 234 that extends from the hood 38. The open portion of the "U" shaped profile 234A can be placed over the vent member 172. Once placed in the vent member 172, the fastening ends 238 of the "U" shaped profile 234A can be closed around the vent member 172 and attached to one another using a fastener 240, as described herein. Using this configuration of the device, the hood 38 and the adapter strap 234 form a single unit that can be installed onto the vent member 172 in a single operation without the need for separately attaching multiple components.

It is contemplated that the adapter strap 234 can be attached to the hood 38 through various operations and at various times. The adapter strap 234 can be attached to the hood 38 during manufacture, such as through welding or through the use of fasteners 240. On-site installation of the adapter strap 234 onto the hood 38 can also occur using the attachment features 236 described herein as well as other fastening mechanisms and methods.

It is contemplated that the vent enclosure 10 described herein can be used with any one of various vent members 172. Such vent members 172 can include, but are not limited to, vent members 172 having doors 32, louvres, baffles, and other similar configurations. It is also contemplated that the vent enclosure 10 can be utilized in various residential, commercial and industrial applications that can include, but are not limited to, dryer vents, airflow vents, exhaust vents, and other similar configurations.

As exemplified in FIGS. 1-15, the vent enclosure 10 is typically configured to be oriented in a generally vertical configuration such that the door 32 operates about a horizontal rotational axis 150. It is also contemplated that the vent enclosure 10 can also be operated with doors 32 that are positioned in alternate configurations. Such configurations can include, but are not limited to, a horizontal configuration where the door 32 opens upward, such as in a roof-vent configuration.

It will be understood by one having ordinary skill in the art that construction of the described device and other components is not limited to any specific material. Other exemplary embodiments of the device disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above is merely for illustrative purposes and not intended to limit the scope of the device, which is defined by the following claims as interpreted according to the principles of patent law, including the Doctrine of Equivalents.

What is claimed is:

1. A vent enclosure comprising:

an adapter strap that is configured to extend around a vent member, the adapter strap having a plurality of attachment features, the adapter strap having fastening ends;

a fastener that is attached to the fastening ends to secure the adapter strap in an encircling position; and a hood that is attached to the plurality of attachment features of the adapter strap, wherein the encircling position defines a receiver that secures the adapter strap relative to the vent member and positions the plurality of attachment features relative to the vent member, the receiver being positioned within an inner perimeter of the adapter strap and the plurality of attachment features being positioned around an outer periphery of the adapter strap, wherein the plurality of attachment features extend inward relative to the adapter strap and toward the receiver, wherein the plurality of attachment features include a plurality of receptacles that open to the outer periphery of the adapter strap, and wherein the plurality of receptacles selectively receive respective attachment protrusions of the hood to secure the hood to the adapter strap in the encircling position.

2. The vent enclosure of claim 1, wherein the plurality of attachment features in the encircling position locates the hood to extend over the adapter strap and covers the receiver that is formed within the inner perimeter of the adapter strap in the encircling position.

3. The vent enclosure of claim 2, wherein the receiver is configured to receive the vent member.

4. The vent enclosure of claim 1, wherein the fastener is a threaded fastener that extends through at least one of the fastening ends.

5. The vent enclosure of claim 1, wherein the plurality of attachment features include a plurality of slots that receive inwardly-extending pins of the hood.

6. The vent enclosure of claim 1, wherein the plurality of attachment features include a plurality of openings that receive inwardly extending-pins of the hood.

7. The vent enclosure of claim 1, wherein the fastening ends include a plurality of apertures that are configured to receive the fastener to define the inner perimeter of the encircling position of the adapter strap.

8. The vent enclosure of claim 1, wherein the hood includes a generally truncated shape that tapers inward to form a lower edge to an upper edge, the upper edge being narrower than the lower edge, and wherein the truncated shape is configured to provide a stacked configuration with respect to a plurality of hood enclosures.

9. The vent enclosure of claim 1, wherein the plurality of receptacles define opposing receptacles that are configured to receive the attachment protrusions of the hood.

10. The vent enclosure of claim 9, wherein the receptacles include corresponding slots within the adapter strap.

11. The vent enclosure of claim 9, wherein the receptacles include openings defined within the adapter strap that are configured to receive the attachment protrusions of the hood through a resilient flexing engagement.

12. The vent enclosure of claim 9, wherein the receptacles include a combination of slots and openings that are configured to receive the attachment protrusions of the hood.

13. The vent enclosure of claim 1, wherein the attachment features provide an attachment space that is configured to receive the attachment protrusions of the hood.

14. The vent enclosure of claim 13, wherein the attachment space is configured to set the adapter strap apart from the hood.

* * * * *